US010730659B2

(12) United States Patent
Lee-Smith et al.

(10) Patent No.: US 10,730,659 B2
(45) Date of Patent: Aug. 4, 2020

(54) RECONFIGURABLE CONTAINER

(71) Applicants: Addis Housewares Limited, Bridgend (GB); Harsa Studio Ltd., Barkan (IL)

(72) Inventors: Martyn Lee-Smith, Bridgend (GB); Yehuda Cohen, Moshav Timorim (IL); Refael Minyan, Gedera (IL)

(73) Assignees: Addis Housewares Limited, Bridgend (GB); Harsa Studio Ltd., Barkan (IL)

( * ) Notice: Subject to any disclaimer, the term of this patent is extended or adjusted under 35 U.S.C. 154(b) by 17 days.

(21) Appl. No.: 16/009,271

(22) Filed: Jun. 15, 2018

(65) Prior Publication Data

US 2019/0308768 A1 Oct. 10, 2019

(30) Foreign Application Priority Data

Apr. 6, 2018 (EP) ..... 18275049

(51) Int. Cl.
*B65D 21/02* (2006.01)
*B65D 6/18* (2006.01)
(Continued)

(52) U.S. Cl.
CPC ..... *B65D 11/1846* (2013.01); *A45C 5/08* (2013.01); *A45C 7/0054* (2013.01); *B65D 11/14* (2013.01);
(Continued)

(58) Field of Classification Search
CPC ..... B65D 11/14; B65D 11/1846; B65D 7/24; B65D 7/26; B65D 7/30; B65D 25/2888; A45C 7/0036; A45C 13/005
(Continued)

(56) References Cited

U.S. PATENT DOCUMENTS 1,051,274 A 1/1913 Schmall
2,558,126 A * 6/1951 Davenport ..... B65D 7/26 220/6
(Continued)

FOREIGN PATENT DOCUMENTS

CN 2339506 9/1999
DE 29709271 7/1997
(Continued)

OTHER PUBLICATIONS

Great Britain Search Report dated Sep. 19, 2018 for Application No. GB1705566.6 filed on Apr. 6, 2017.
(Continued)

*Primary Examiner* — Elizabeth J Volz
(74) *Attorney, Agent, or Firm* — A.C. Entis-IP Ltd.; Allan C. Entis

(57) ABSTRACT

A reconfigurable container is disclosed, the container being reconfigurable between a first configuration in which the container defines a receptacle for receiving an item, and a second configuration in which the container comprises a collapsed configuration for storage. The container comprises: a base and a wall which is arranged to extend around the base, the wall comprising at least two hingedly coupled wall portions, the base being hingedly coupled to a lower region of at least one wall portion, the wall further comprising a ledge disposed along a lower region thereof which is arranged to extend inwardly of the container, for supporting the base when the container is configured in the first configuration.

15 Claims, 9 Drawing Sheets

(51) Int. Cl.

| | |
|---|---|
| ***B65D 6/08*** | (2006.01) |
| ***B65D 25/28*** | (2006.01) |
| ***A45C 7/00*** | (2006.01) |
| ***A45C 5/08*** | (2006.01) |
| *A45C 13/00* | (2006.01) |
| *B65D 25/30* | (2006.01) |

(52) U.S. Cl.
CPC ..... *B65D 11/186* (2013.01); *B65D 25/2888* (2013.01); *A45C 7/0036* (2013.01); *A45C 13/005* (2013.01); *B65D 25/30* (2013.01)

(58) Field of Classification Search
USPC ..... 220/4.28, 4.29, 4.33, 4.34, 6
See application file for complete search history.

(56) References Cited

U.S. PATENT DOCUMENTS

| | | | | | |
|---|---|---|---|---|---|
| 2,780,381 | A | * | 2/1957 | Coit, Jr. | B65D 19/12 220/6 |
| 3,254,786 | A | * | 6/1966 | Melville | B65D 11/1846 220/6 |
| 5,458,255 | A | | 10/1995 | Addeo et al. | |
| 5,706,555 | A | | 1/1998 | Furtner | |
| 2008/0302789 | A1 | | 12/2008 | Stevenson | |

FOREIGN PATENT DOCUMENTS

| | | | | |
|---|---|---|---|---|
| EP | 0800998 | | 10/1997 | |
| FR | 1494178 | | 9/1967 | |
| GB | 122616 | | 1/1919 | |
| GB | 859967 | | 1/1961 | |
| GB | 2367283 | * | 4/2002 | B65D 1/22 |
| GB | D6025418 | | 1/2018 | |
| GB | D6028837 | | 2/2018 | |
| IL | D62107 | | 2/2019 | |
| JP | 0664644 | | 3/1994 | |
| JP | H10324332 | | 12/1998 | |
| JP | 2017128355 | | 7/2017 | |
| WO | 03086735 | | 10/2003 | |

OTHER PUBLICATIONS

European Search Report dated Jul. 5, 2018 for Application No. 18275049.7 filed Apr. 6, 2018.
Japanese Office Action dated May 19, 2020 for Application No. 2019-031021, filed Feb. 22, 2019.

* cited by examiner

RECONFIGURABLE CONTAINER

RELATED APPLICATIONS

This application claims benefit under 35 U.S.C. § 119(a)-(d) of European Patent Application 18275049.7 filed on Apr. 6, 2018, the disclosure of which is incorporated herein by reference in its entirety.

BACKGROUND

The present invention relates to a reconfigurable container.

Containers come in a variety of sizes and shapes and are used in a variety of different applications. Containers typically occupy a significant volume of space and as such when the containers are not required, there is a clear need to provide alternative ways of storing containers where conventional storing techniques, such as stacking the containers together is not possible, or where there is a lack of storage space.

One example of such an application is transporting laundry in a household environment. Laundry baskets are typically unsightly and can occupy a significant area of floor space in a room where floor space for example, may be a premium.

Accordingly, it is an object of the present invention to provide a technical solution to at least some of the issues outlined above and which provides a container which is easily stored when not needed.

SUMMARY

In accordance with the present invention, there is provided a reconfigurable container, the container being reconfigurable between a first configuration in which the container defines a receptacle for receiving an item, and a second configuration in which the container comprises a collapsed configuration for storage, the container comprising:

- a base and a wall which is arranged to extend around the base,
- the wall comprising at least two hingedly coupled wall portions,
- the base being hingedly coupled to a lower region of at least one wall portion,
- the wall further comprising a ledge disposed along a lower region thereof which is arranged to extend inwardly of the container, for supporting the base when the container is configured in the first configuration.

In an embodiment, the first and second wall portions are hingedly coupled together along a lateral edge thereof.

In an embodiment, each wall portion comprises a plurality of wall segments interconnected by a plurality of hinges which permit the wall segments to flex relative to each other about the respective hinge. The hinges may comprise a flexure hinge which may be formed via a crease, a score line, or a line of reduced thickness within the respective wall portion, for example.

In an embodiment, the base comprises a frame and a support which extends upon the frame. The base further comprises a peripherally extending lip which extends from the support to form an overhang. The lip is preferably arranged to engage with the ledge. In this respect, the ledge and lip cooperate to prevent the base from rotating about the hinged coupling out through a lower region of the container.

In an embodiment, the base further comprises coupling means disposed along at least a portion of a peripheral edge thereof for forming the hinge coupling with a complimentary coupling means disposed along the lower region of the at least one wall portion.

In an embodiment, the base further comprises a recess formed along a portion of the peripheral edge thereof, substantially opposite the coupling means, for enabling a user to manipulate the base to reconfigure the container.

In an embodiment, the wall further comprises locking means for locking the base to the ledge for maintaining the container in the first configuration. The locking means may comprise a plurality of protuberances disposed upon the wall portions, which extend inwardly of the container, proximate the lower region of the wall, for locking the base to the ledge for maintaining the container in the first configuration. The base is arranged to slide over the protuberances once a threshold force has been applied to the base, to enable the base to rotate about the hinged coupling and the container to reconfigure between the first and second configurations.

In an alternative embodiment, the base comprises a first and second base portion and first and second orthogonal axis, the first and second base portions being disposed either side of a first axis, the first axis defining a hinge about which the first and second base portions can pivot, and wherein the base is hingedly coupled to the lower region of the wall at a location comprising at least opposite ends of a second axis of the base.

In an embodiment, the base is coupled to the wall at a plurality of discrete locations. In an embodiment, each of the wall segments are separately hingedly coupled to the base.

In an embodiment, the first axis comprises a major axis and the second axis comprises a minor axis. Preferably, the base comprises an elliptical shape.

In an embodiment, the base and the at least two wall portions extend in substantially parallel planes, when the container is configured in the second configuration, to form a substantially flattened configuration.

In an embodiment, the base extends substantially orthogonal to the at least two wall portions when the container is configured in the first configuration. In an alternative embodiment, when the container is configured in the first configuration, the at least two wall portions diverge with respect to each other in a direction which is away from the base.

In an embodiment, the wall and base are formed of a plastics material, and the wall comprises a plurality of apertures.

Whilst the invention has been described above, it extends to any inventive combination of features set out above or in the following description. Although illustrative embodiments of the invention are described in detail herein with reference to the accompanying drawings, it is to be understood that the invention is not limited to these precise embodiments.

Furthermore, it is contemplated that a particular feature described either individually or as part of an embodiment can be combined with other individually described features, or parts of other embodiments, even if the other features and embodiments make no mention of the particular feature. Thus, the invention extends to such specific combinations not already described.

BRIEF DESCRIPTION OF THE FIGURES

The invention may be performed in various ways, and, by way of example only, embodiments thereof will now be described with reference to the accompanying drawings, in which.

DETAILED DESCRIPTION

Figure 1A:
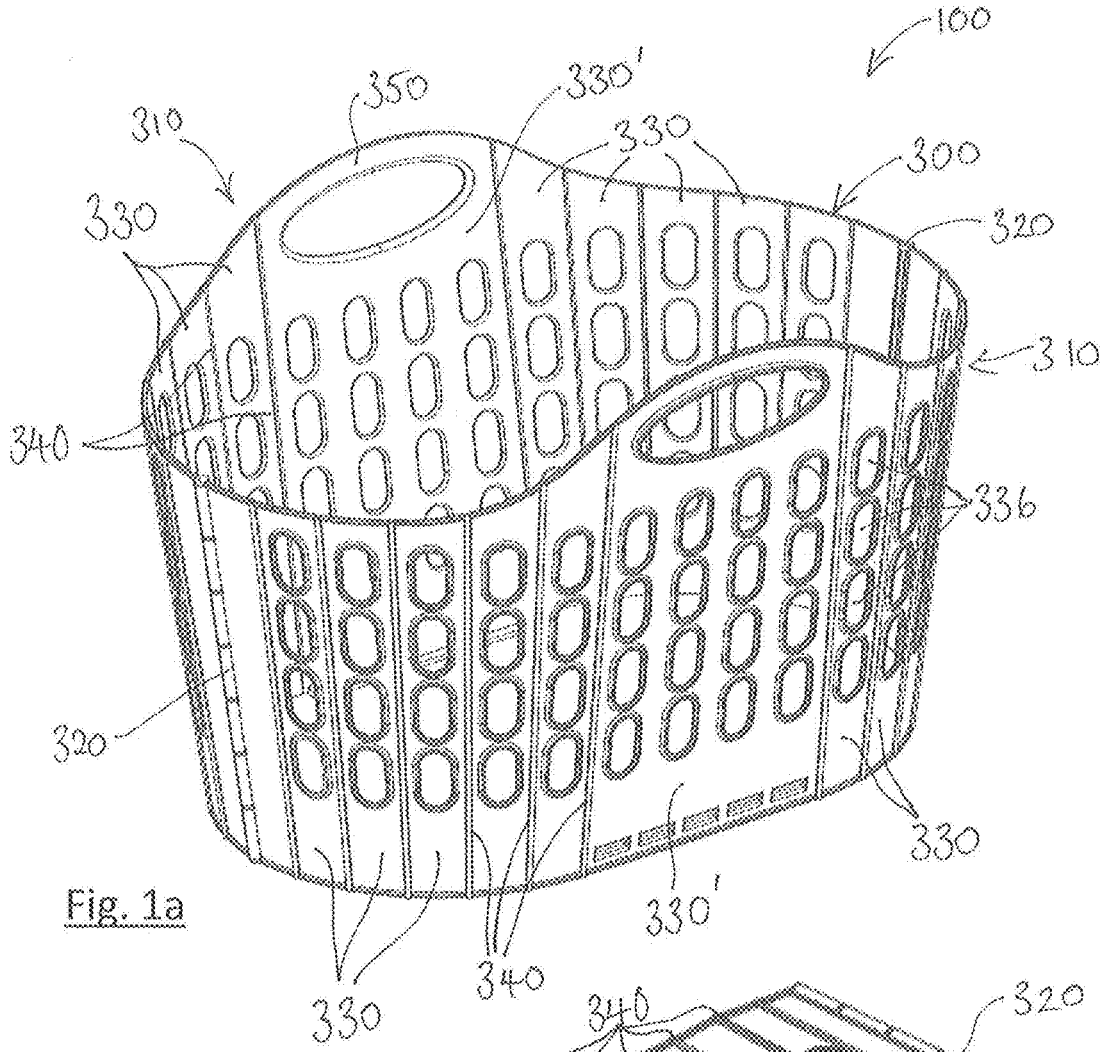
FIG. 1*a* is a perspective view of a reconfigurable container according to an embodiment of the present invention, arranged in a first configuration.
Figure 1B:
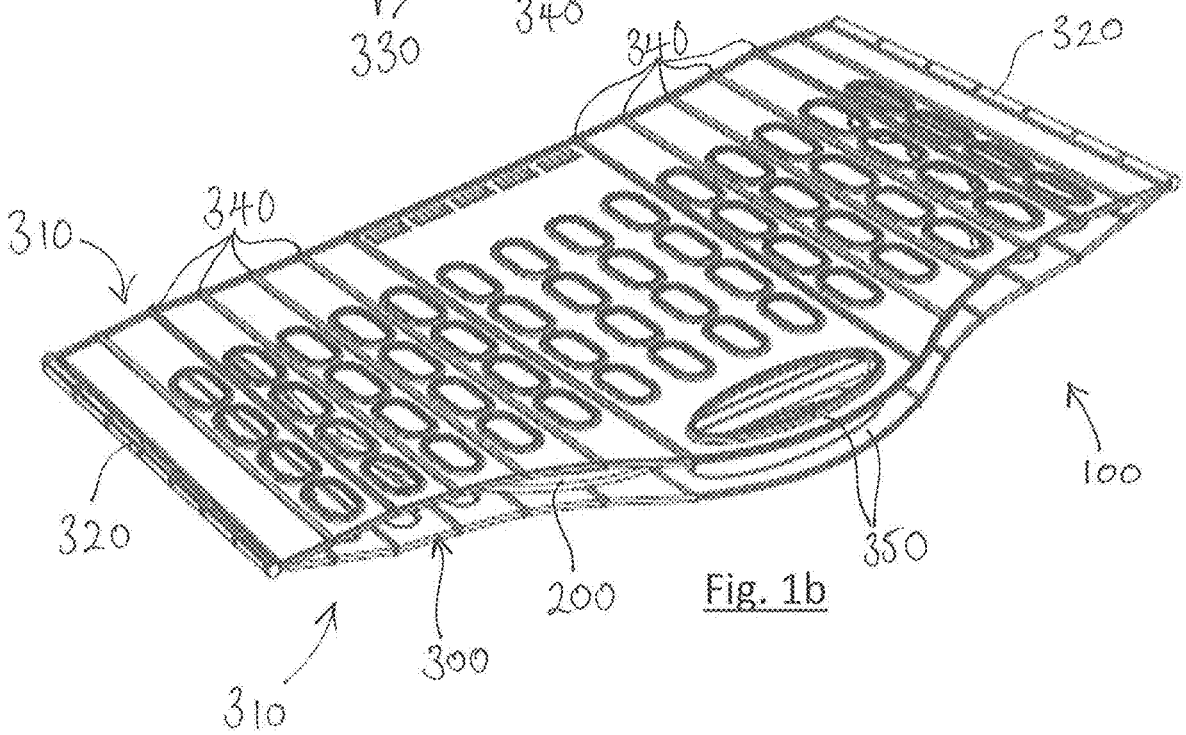
FIG. 1*b* is a perspective view of a reconfigurable container according to an embodiment of the present invention, arranged in a second configuration.
Figure 2:
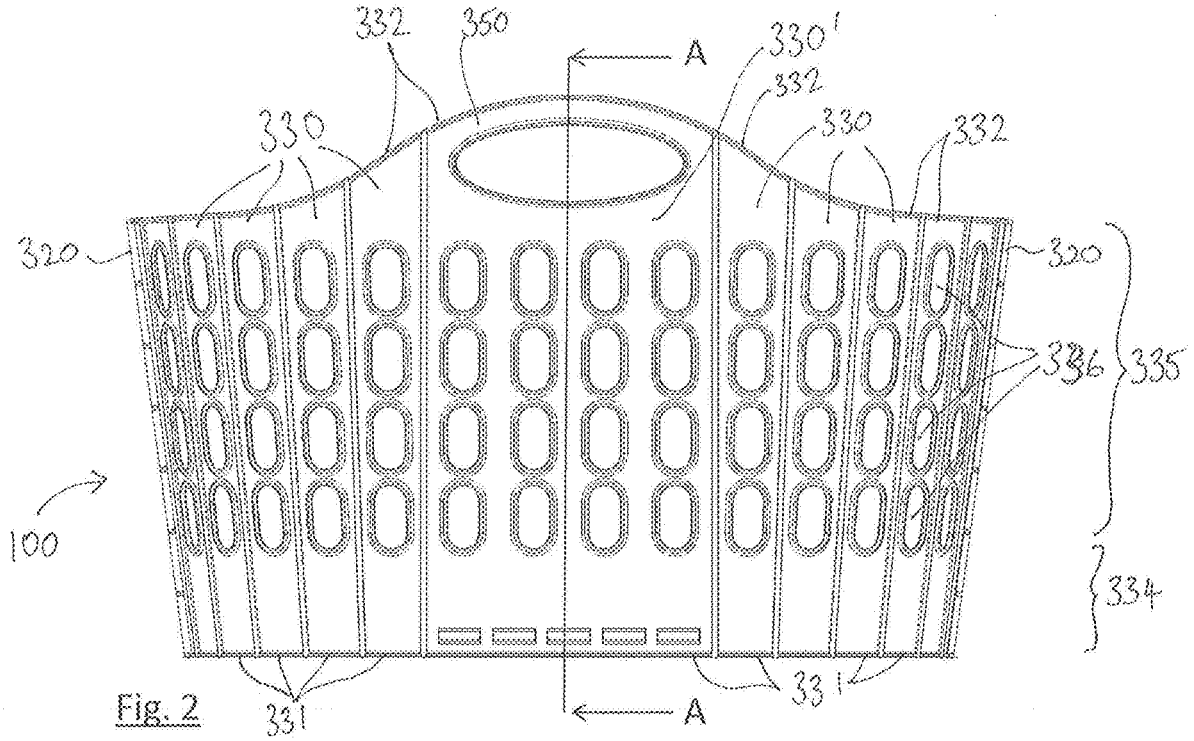
FIG. 2 is a front view of the container illustrated in FIG. 1*a;*
Figure 3:
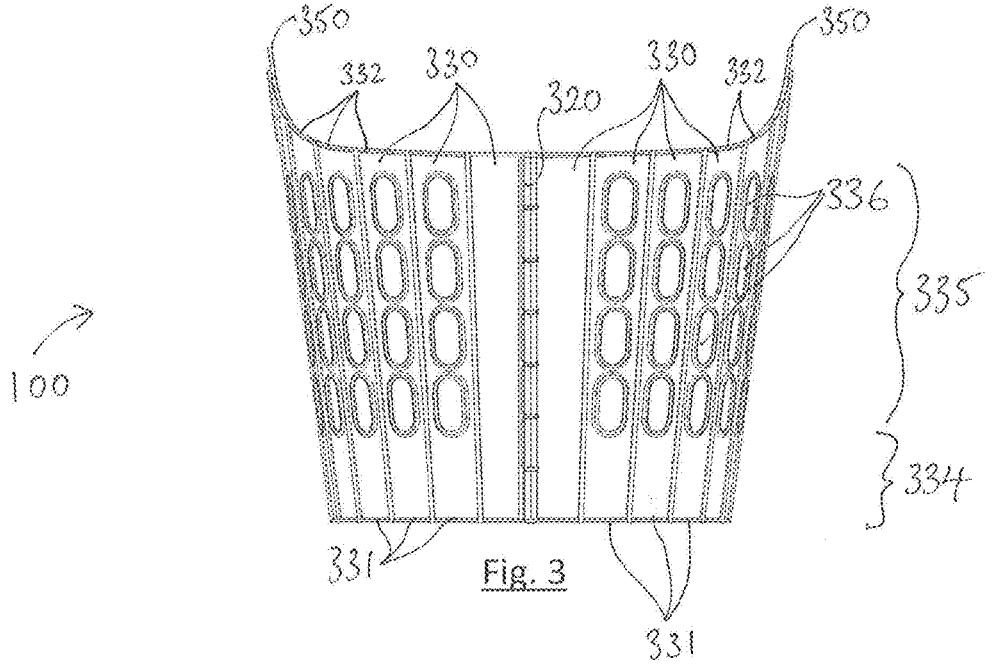
FIG. 3 is a side view of the container illustrated in FIG. 1*a;*
Figure 4:
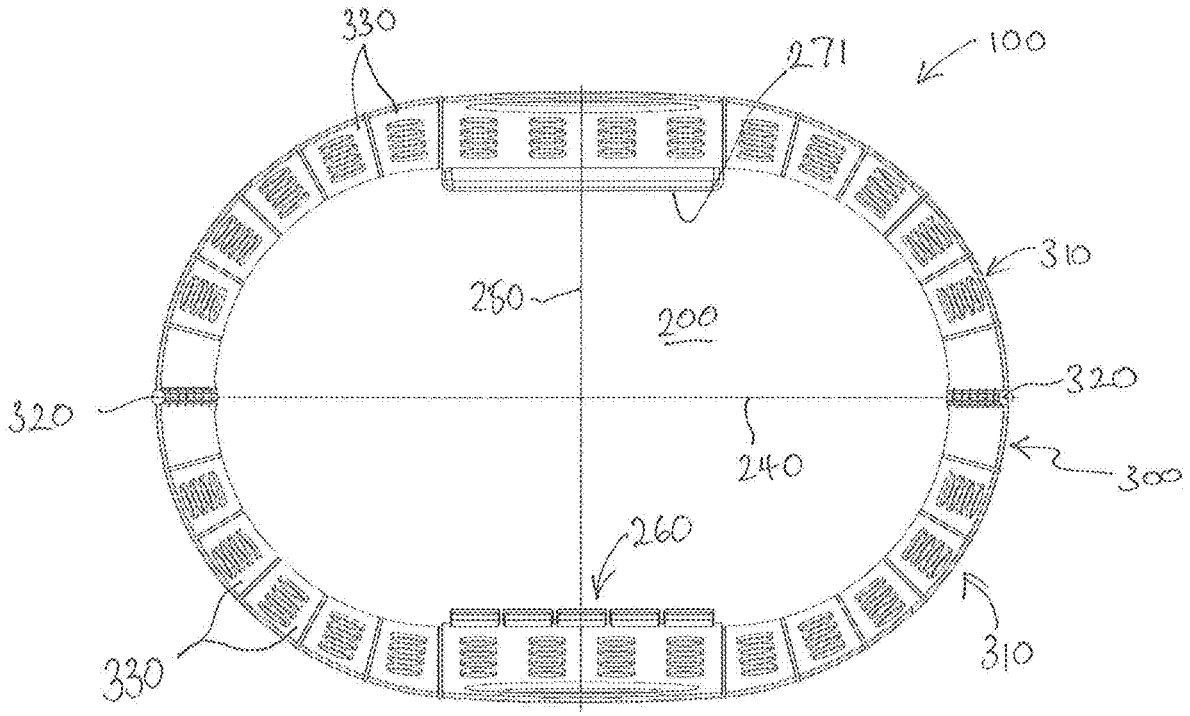
FIG. 4 is a plan view of the container illustrated in FIG. 1*a;*

Referring to FIG. 1*a*-FIG. 4 of the drawings, there is illustrated a reconfigurable container 100, such as a reconfigurable laundry container 100, according to an embodiment of the present invention. The container 100 is reconfigurable between a first configuration (as illustrated in FIG. 1*a* in which the container 100 defines a receptacle for receiving items, and a second configuration (as illustrated in FIG. 1*b*) in which the container 100 is arranged in a substantially flattened configuration for storage.

Figure 9A:
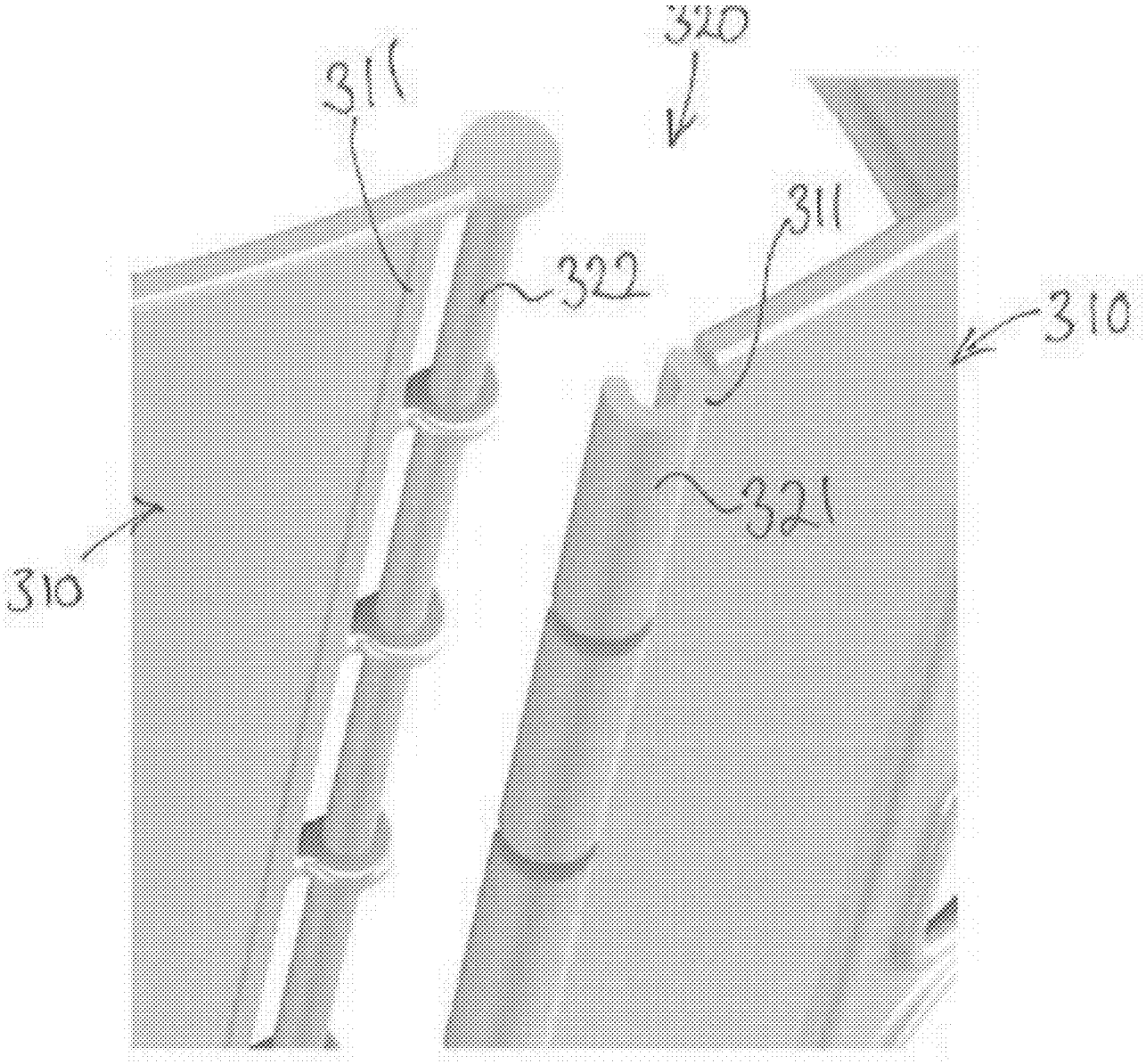
FIG. 9A is a perspective view of the lateral edge of a first and second wall portion illustrating the coupling means.

The container 100 comprises a base 200 (see FIG. 5, FIG. 6*a* and FIG. 6*b* of the drawings) and a wall 300 which extends around the base 200. The base 200 and wall 300 may be formed of a plastics material such as polypropylene or polyethylene, and in the first configuration the base 200 is disposed at a lower region of the wall 300 and the wall 200 extends upwardly away from a peripheral edge 231 of the base 200. In the illustrated embodiment, the wall 300 comprises two wall portions 310 which separately form opposing half-sections of the wall 300. The wall portions 310 are hingedly coupled together along lateral side edges 311 thereof by coupling means 320, which permit the wall portions to pivot with respect to each other. Referring to FIG. 9A of the drawings, the coupling means 320 may comprise an elongate C-shaped channel 321, disposed along one lateral side edge 311 of one wall portion 310 and a rod 322 or similar shaped formation disposed along the opposite lateral edge 311. The rod formation 322 disposed at one lateral edge 311 of one wall portion 310, is arranged to snap-locate within the C-shaped channel 321 disposed along the lateral edge 311 of the adjacent wall portion 310 such that when the wall portions 310 are coupled together, the resulting wall 300 encircles the base 200.

Figure 9B:
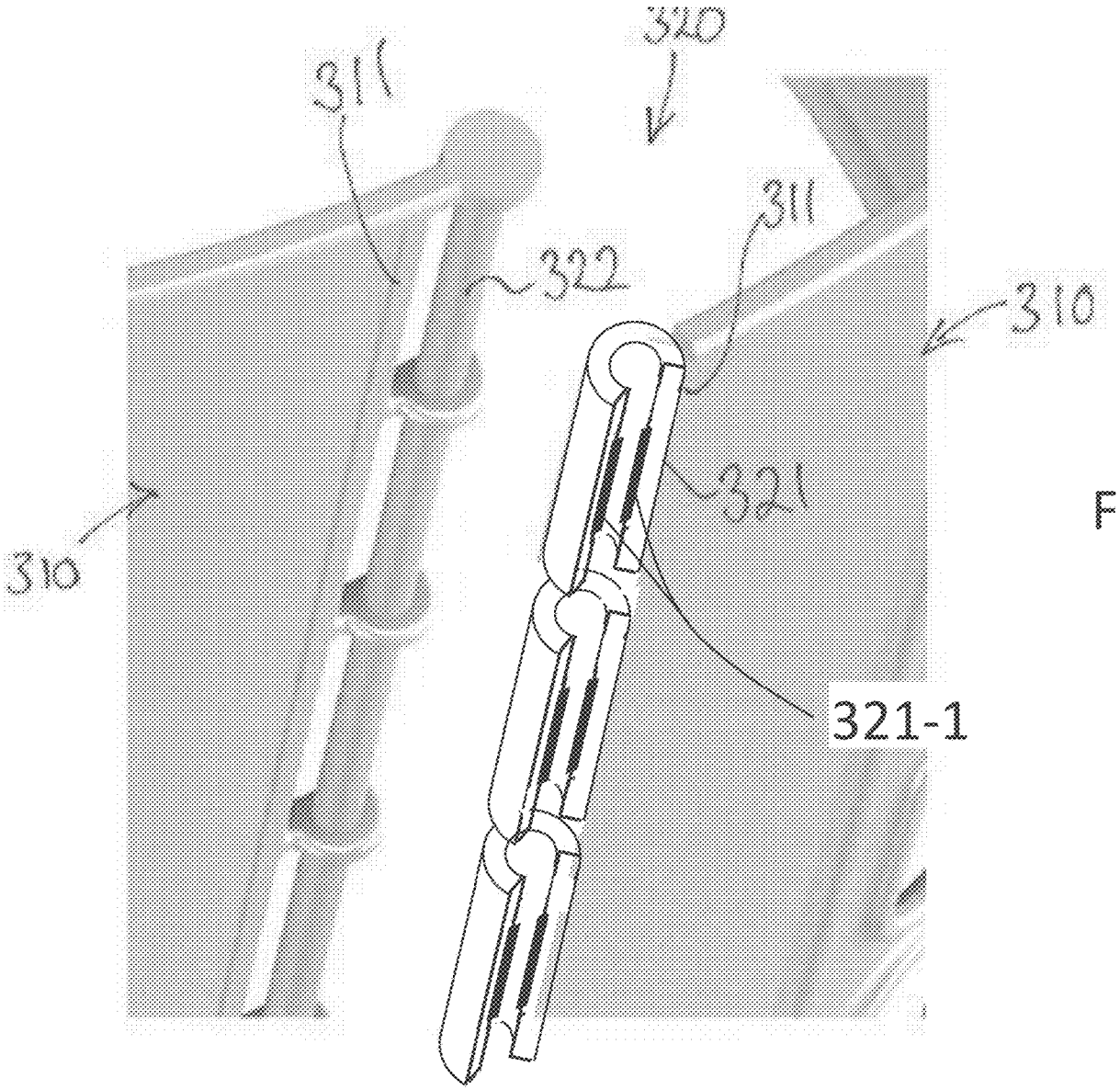
FIG. 9B is a perspective view of the lateral edge of a first and second wall portion illustrating a variation of the coupling means; and, FIG. 10 is a magnified view of an interior portion of the container illustrated in FIG. 1*a*, proximate the base, illustrating the locking means for locking the base to the ledge.

In FIG. 9A the openings of the C-shaped channels 321 through which rod formation 322 is pressed to snap-locate the rod formation to the C-shaped channels are shown facing towards the inside of wall 300 and container 100. In an embodiment, as schematically shown in FIG. 9B, the C-shaped channels 321 are disposed along the one lateral side edge 311 so that their respective openings face towards the outside rather than towards the inside of wall 300 and container 100. Optionally, each C-shaped channel 321 comprises at least one snap-fin 321-1 that operates to secure rod 322 seated in the C-shaped channel after rod 322 has been pressed to snap-locate into the C-shaped channel.

Each wall portion 310 further comprises a plurality of interconnected wall segments 330, each segment comprising a proximal edge 331, which collectively form the lower edge of the wall, a distal edge 332 which collectively form the open periphery of the receptacle, and opposing side edges 333 which extend between the proximal 331 and distal edges 332. The side edges 333 separately extend substantially parallel to each other and the segments 330 are coupled together along opposing side edges 333 via a respective hinge 340, such as a flexure hinge. Each hinge may be realised as a crease within the wall portion, or as a score line within the wall, or simply as a line of reduced wall thickness for example, which permit the wall segments 313 to flex relative to each other.

The wall segments 330 comprise a substantially rectangular shape, and a lower portion 334 of each segment 330 comprises a continuous, solid portion, whereas an upper portion 335 of each segment 330 comprises a plurality of apertures 336. In this respect, the solid portions of the segments 330 cooperate to form a solid wall band which extends around the wall proximate the base 200. Similarly, the apertured portions 336 cooperate to form an apertured portion of the wall 300 disposed, in use, above the wall band. At least two of the wall segments 330 further comprise handles 350, disposed proximate an upper region thereof, for enabling a user to hold and carry the container 100. It is envisaged that the at least two wall segments 330 comprising the handles 350 are diametrically opposed around the wall 300 such that the weight of the container 100 is evenly distributed either side of the handles 350.

Figure 5:
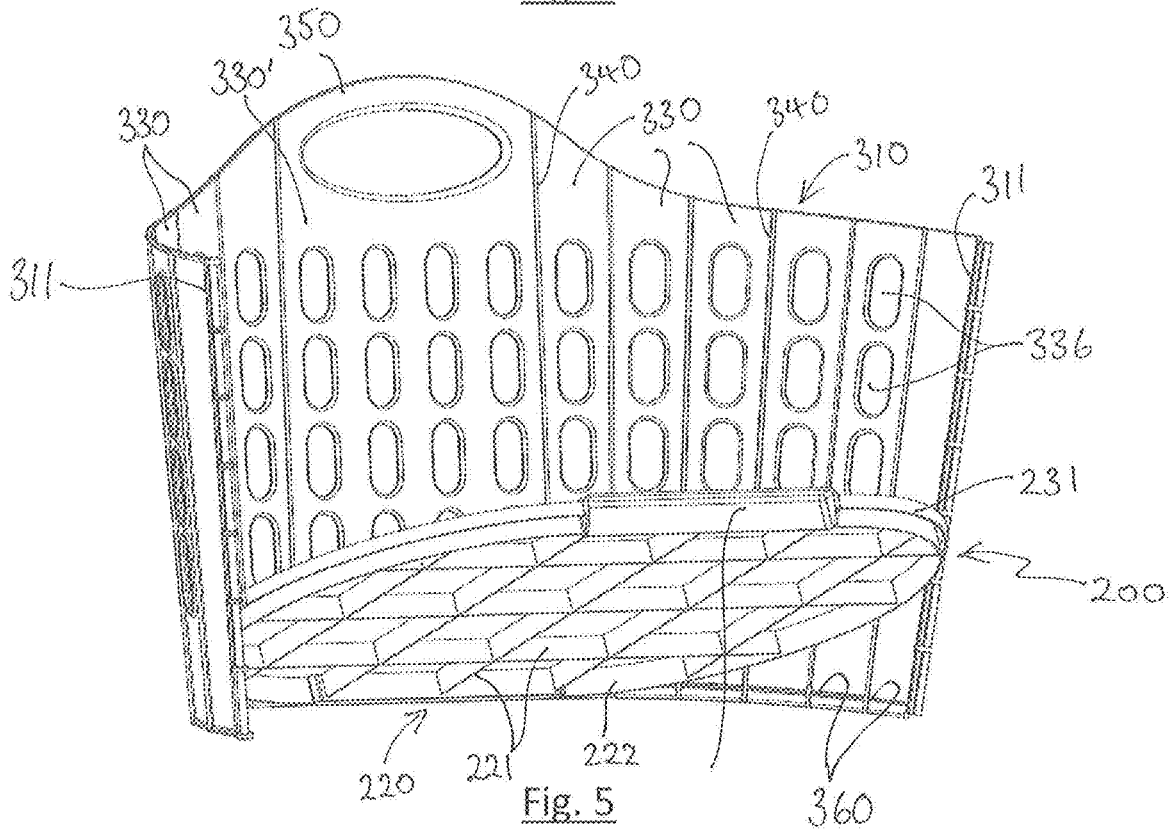
FIG. 5 is a view of the container illustrated in FIG. 1*a*, with one wall portion removed and the base partially rotated about the hinged coupling.
Figure 6A:
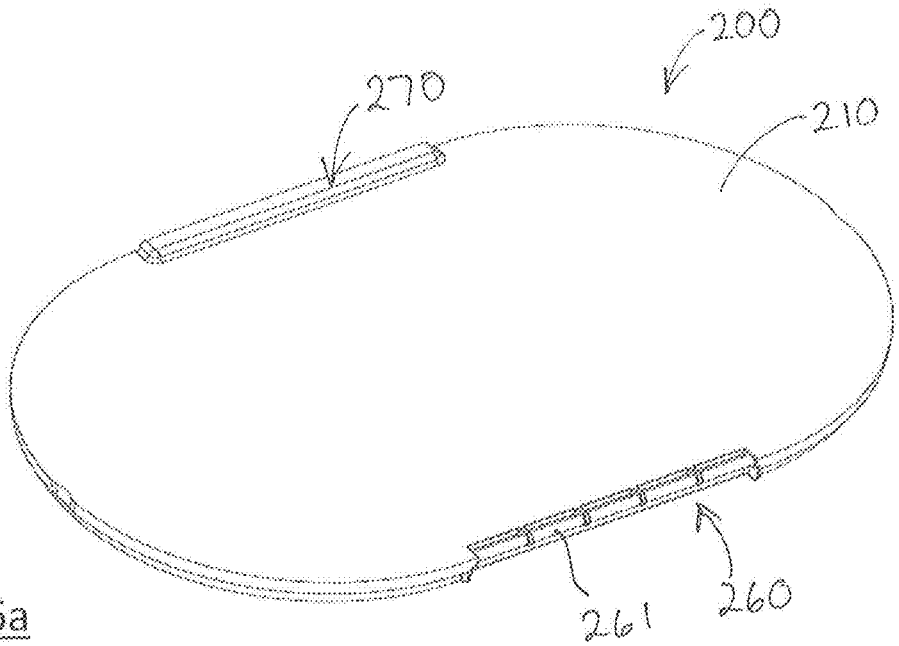
FIG. 6*a* and FIG. 6*b* are perspective views of (a) support (top) and (b) frame (bottom) of the base of a first embodiment of a container.
Figure 6B:
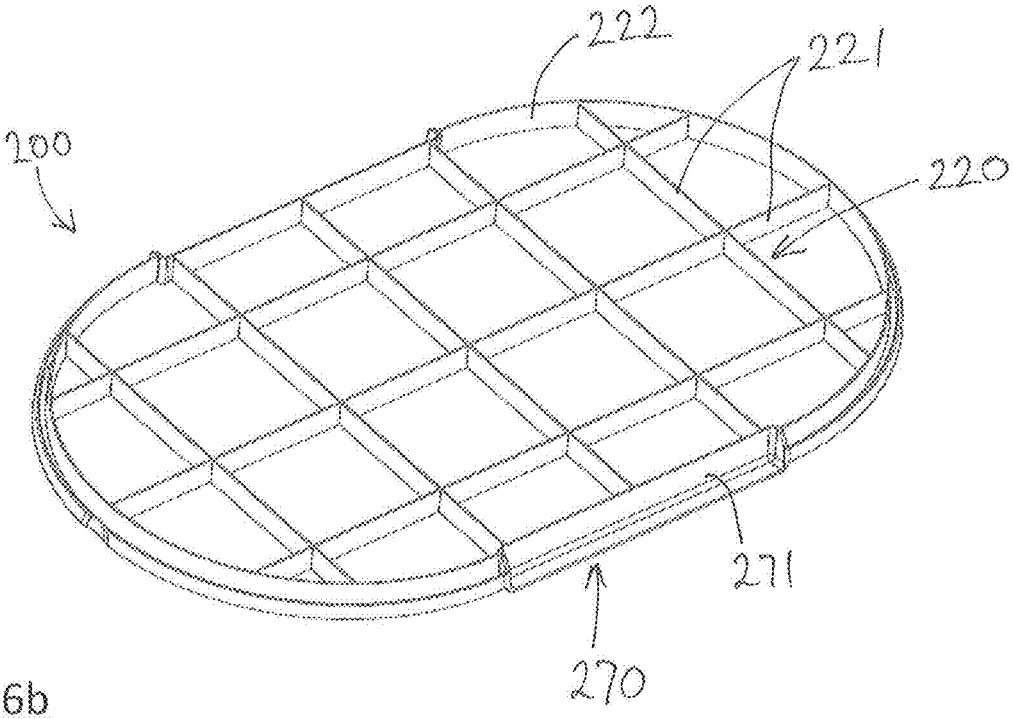

Referring to FIG. 5, FIG. 6*a*, and FIG. 6*b* of the drawings, in a first embodiment of the invention, the base 200 comprises a substantially planar support member 210 disposed upon a substantially planar base frame 220. The frame 220 comprises a plurality of interconnected struts 221 (FIG. 5 and FIG. 6*b*) disposed at an underside of the support member 210. The struts 221 extend between a peripherally extending frame boundary 222 and the base 200 further comprises a peripherally extending lip 230 which extends outwardly from the support member 210, to form an overhang over the frame boundary 222.

Figure 7:
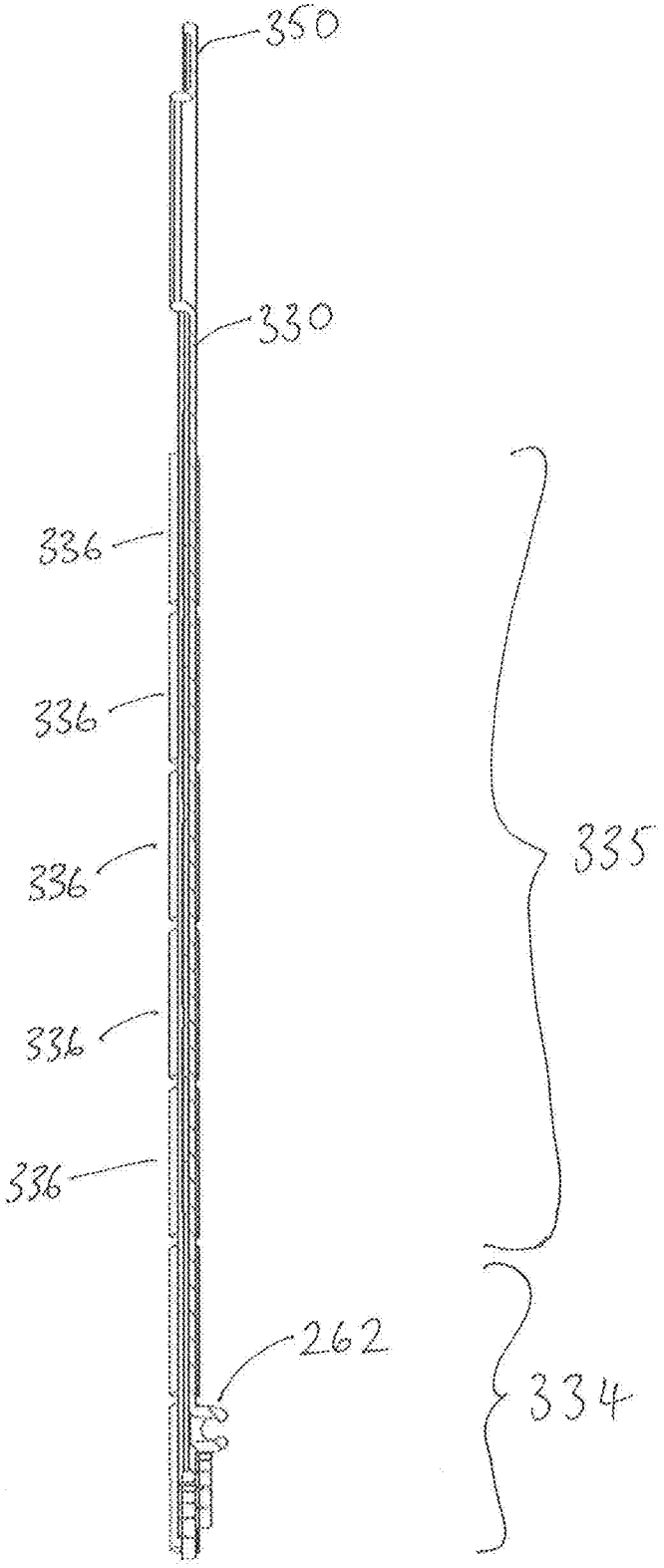
FIG. 7 is a sectional view through a wall portion of the container illustrated in FIG. 2, taken along a line A-A.
Figure 8:
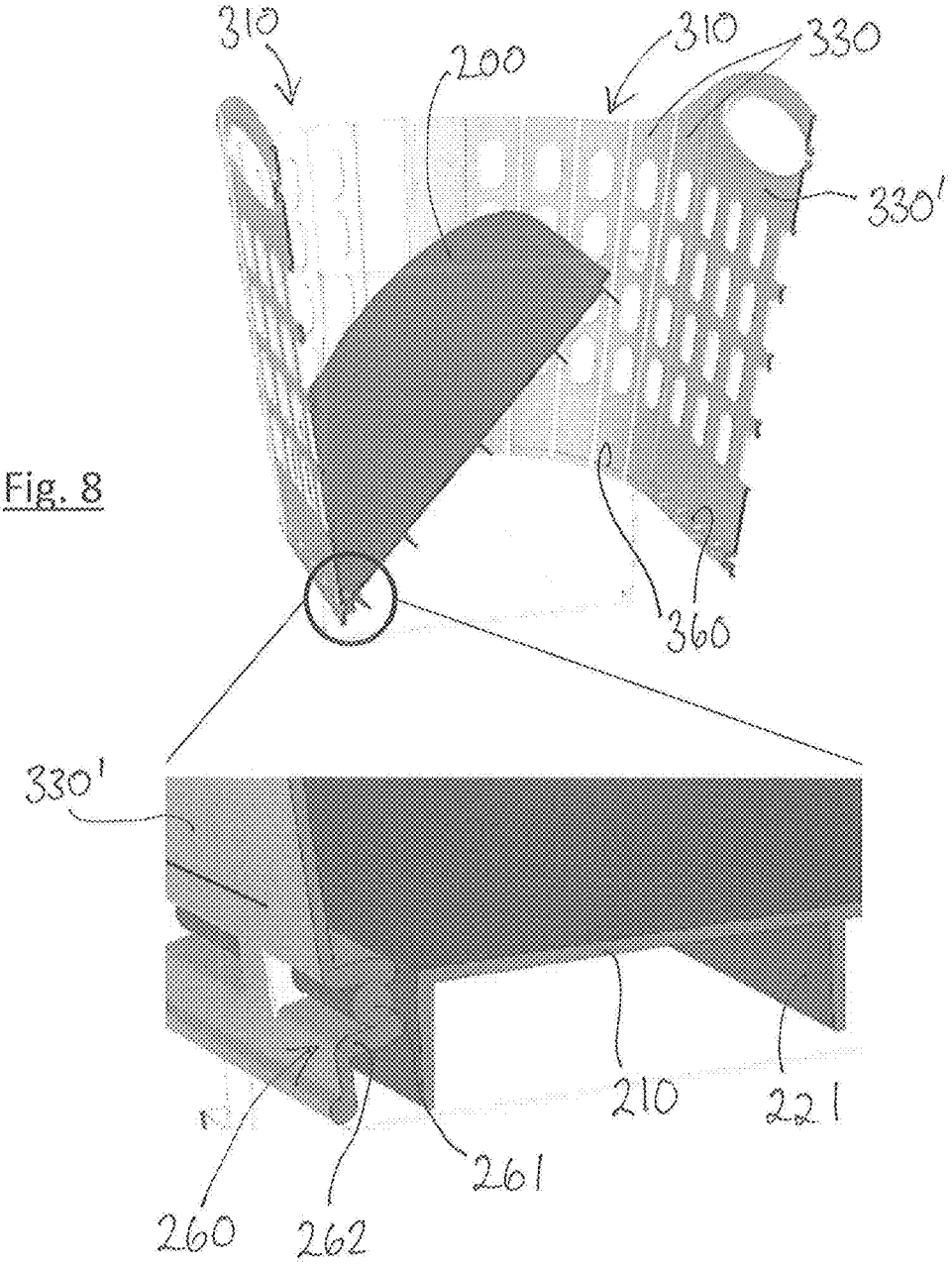
FIG. 8 is a sectional view through the container illustrated in FIG. 1*a*, with the base partially rotated, illustrating the hinge coupling.

The base support member 210 and frame 220 comprise a substantially elliptical shape, having a first and second orthogonal axis 240, 250, such as a major and a minor axis, although the skilled reader will recognise that other shapes may also be used. The base 200 further comprises coupling means 260 disposed along a portion of a peripheral edge 231 thereof, which extends equally, to either side of the second axis 250 at one end thereof. The coupling means 260 comprises an integrally formed rod formation 261 which extends along the peripheral edge, and is arranged to snap-locate within a C-shaped channel 262 formed along a lower region of one of the wall portions 310, namely a central wall segment 330 of the wall portion 310, as illustrated in FIG. 7 and FIG. 8 of the drawings. The C-shaped channel 262 forms part of the coupling means 260 and shaped to compliment the shape and size of the rod formation 261. The coupling means 260 permits the base 200 to pivot with respect to the wall portion 310 so that the container 100 can reconfigure between the first and second configurations and in facilitating this configuration, the base 200 further comprises a handle 270. The handle 270 is disposed at the side of the base opposite the coupling means 260 and comprises a recess 271 formed within the base support 210. The recess 271 enables a user to lift the base 200 by placing their fingers within the recess 271 to engage an underside of the lip 230 of the base 200.

Figure 10:
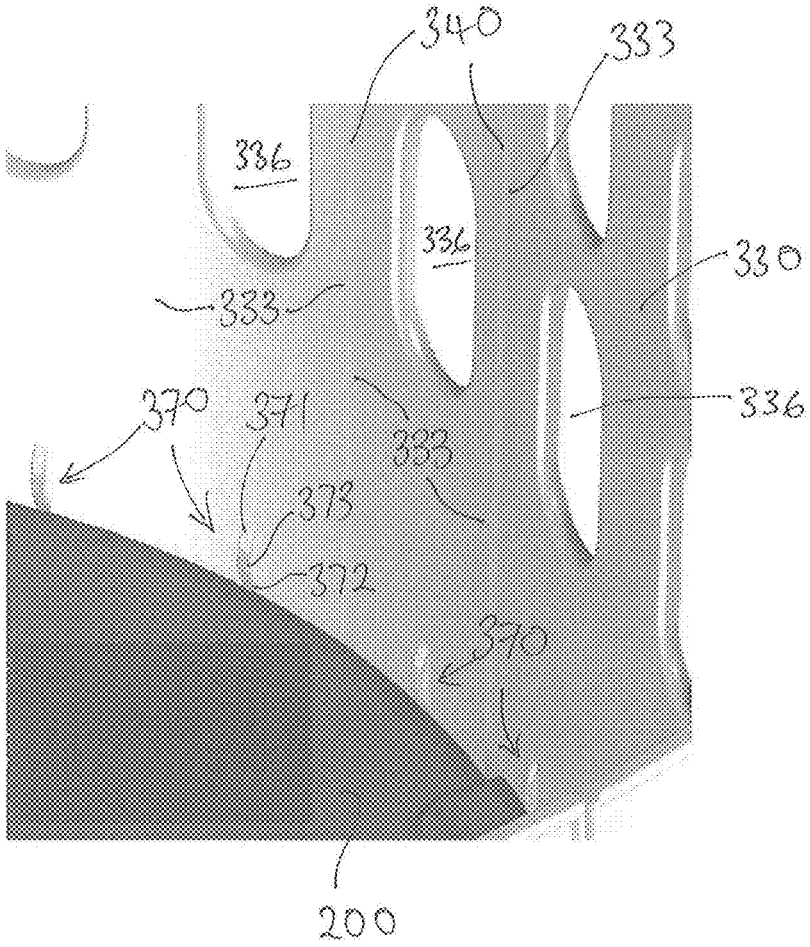

The wall 300 further comprises a ledge 360 formed along an inside face thereof, which extends inwardly of the wall 300 around the wall 300. The ledge 360 is formed along the lower region of the wall 300 and is arranged engage with the lip 230 formed on the base 200 to prevent the base 200 from rotating downwardly out from between the wall portions 310. The ledge 360 acts as a stop and when the base 200 is positioned upon the ledge 360, the base frame 220 and support 210 minimise any flexing between the wall segments 330 and also minimise any pivoting of the wall portions 310, thereby maintaining the shape of the resulting receptacle. Referring to FIG. 10 of the drawings, the wall segments 330 further comprise locking means, which in the illustrated embodiment comprise a plurality of protuberances 370 disposed along the lower region thereof which extend inwardly of the container. The protuberances 370 separately comprise a leading and trailing ramped face 371, 372, with respect to movement of the base 200, either side of a raised pedestal region 373, such that a peripheral edge 231 of the base lip 230 is required to engage a ramp face 371, 372 and thus urge the wall portion 310 away from the lip 230 in order for the base 200 to ride over the pedestal 373. The protuberances 370 thus act to lock the base 200 to the ledge 360 to minimise any unintentional movement of the base 200 away from the ledge 360.

In the first container configuration, the base 200 is arranged to extend in a plane substantially perpendicular to the wall 300. However, in an alternative embodiment, it is envisaged that the peripherally extending wall 300 may diverge in a direction which is away from the base 200, such that the open periphery of the container 100 comprises a larger cross-sectional area than the base 200. During use, in order to reconfigure the container 100 from the first configuration to the second configuration, a user places their fingers within the recess 271 to engage an underside of the lip 230 of the base 200 and lifts the base 200. In this respect, it is evident that the user will need to lift with at least a threshold force to overcome the resistance presented by the protuberances 370. As the user lifts the base 200, the base 200 will pivot about the coupling means 260 and can be reconfigured to extend substantially parallel with the wall portion 310 with which the base 200 is coupled. With the base reconfigured, the adjacent wall portion 310 can then be collapsed onto the base 200 owing to the coupling along the lateral edges thereof, so that both wall portions 310 and base 200 extend in substantially parallel planes, thereby forming a substantially flattened, second configuration.

In order to reconfigure the container to the first configuration, the user subsequently encourages the separation of the wall portions 310 and at the same time, pushes the base 200 between the wall portions 310, thereby causing the base 200 to rotate about the coupling means 260. The user continues with the rotation of the base 200 and in doing so, the lip 230 will engage with the inside face of the wall portions 310 causing them to separate and adopt the shape of the first configuration. However, as the base nears the ledge 360, the user will similarly need to press the base 200 with at least a threshold force required to overcome the resistance presented by the protuberances 370.

In a second embodiment of the invention, which is not illustrated, the base 200 is arranged to fold about the first axis 240 as the container 100 reconfigures between the first and second configuration. The further features of the container 100 of the second embodiment are substantially the same as the first embodiment and so like features will be referenced with the same numerals in the following description.

The first axis 240 of the base 200 of the container 100 of the second embodiment defines an axis of symmetry of the base 200 and separates the base 200 into a first and second base portion which extend at opposite sides of the first axis 240. The first and second base portions are hingedly coupled along the first axis 240 and this coupling maybe be formed by a score line formed in the base support 210, or a hinge for example, which extends along the first axis 240. In this embodiment, it is also evident that the base frame 220 will comprise two separated sections (not shown) either side of the first axis 240, to enable the base to fold. The base 200 is hingedly coupled to the wall 300 at a plurality of discrete coupling regions. In particular a proximal region of at least the wall segments 330 located at opposite ends of the second axis 250 of the base 200, namely the central wall segments 330' of each wall portion 310, are coupled to a peripheral edge of the base 200 in a manner similar to that described above with respect to the first embodiment. The base 200 of the second embodiment thus comprises a further coupling means at the position of the handle 270 of the base 200 of the first embodiment.

In order to reconfigure the container 100 from the first configuration to the second configuration, a user presses the underside of the base 200 to cause the base to deflect to the interior of the receptacle, pass over the protuberances 370, and fold about the first axis 240. As the base folds inwardly of the receptacle about the first axis 240, the wall 300 and particularly the wall segments 330 disposed at opposite sides of the second axis 250 will move toward each other as the peripheral regions of the base 200, either side of the first axis 240, move toward each other. As the base 200 continues to fold, an underside of the first and second base portion will eventually contact each as the container 100 adopts the second configuration. When configured in this second configuration, the first and second base portions and the wall segments 330 disposed at either side of the base portions, extend in substantially parallel planes, thus forming a substantially flattened configuration, which occupies less space than the first configuration and can thus be conveniently stored.

In order to reconfigure the container of the second embodiment to the first configuration, the user presses upon the base 200, proximate the first axis 240, to cause the base 200 to move relative to the wall segments 330 in a direction which is toward a lower region of the container 100. As the fold between the base portions moves inwardly of the container between the wall segments 330, the peripheral regions of the base 200 either side of the second axis 250 will begin to move away from each other as the base 200 adopts a more planar configuration. Also during this configuration, the wall segments 330 will flex and rotate relative to each other as the proximal edge of each segment follows the peripheral edge of the base 200. As the base 200 reconfigures to the first configuration, the user will need to press the base 200 with at least a threshold force required to overcome the resistance presented by the protuberances 370, in order for the base 200 to locate upon the ledge 360 of the wall 300 and adopt a planar configuration.

From the foregoing therefore it is evident that the present invention provides for a more versatile and compact container.

The invention claimed is:

1. A reconfigurable container, the container being reconfigurable between a first configuration in which the container defines a receptacle for receiving an item, and a second configuration in which the container comprises a collapsed configuration for storage, the container comprising:

a base and a wall which is arranged to extend around the base, the wall comprising first and second wall portions hingedly coupled to each other at their respective lateral edges, the base being hingedly coupled to a lower region of at least one wall portion, the wall further comprising a ledge disposed along a lower region thereof which is arranged to extend inwardly of the container, for supporting the base when the container is configured in the first configuration;

wherein each wall portion comprises a plurality of wall segments interconnected by a plurality of flexure hinges which permit the wall segments to flex relative to each other about the respective hinge.

2. A reconfigurable container according to claim 1, wherein the base comprises a frame and a support which extends upon the frame.

3. A reconfigurable container according to claim 2, further comprising a peripherally extending lip which extends from the support to form an overhang.

4. A reconfigurable container according to claim 3, wherein the lip is arranged to engage with the ledge.

5. A reconfigurable container according to claim 2, further comprising a hinge part disposed along at least a portion of a peripheral edge thereof for forming the hinge coupling with a complimentary hinge part disposed along the lower region of the at least one wall portion.

6. A reconfigurable container according to claim 5 further comprising a recess formed along a portion of the peripheral edge thereof, for enabling a user to manipulate the base to reconfigure the container.

7. A reconfigurable container according to claim 1 further comprising a plurality of protuberances disposed upon the wall portions, which extend inwardly of the container, proximate the lower region of the wall, for locking the base to the ledge for maintaining the container in the first configuration.

8. A reconfigurable container according to claim 1, wherein the base comprises a first and second base portion and first and second orthogonal axis, the first and second base portions being disposed either side of a first axis, the first axis defining a hinge about which the first and second base portions can pivot.

9. A reconfigurable container according to claim 8, wherein the base is hingedly coupled to the lower region of the wall at a location comprising at least opposite ends of the second axis of the base.

10. A reconfigurable container according to claim 9, wherein the base and the at least two wall portions extend in substantially parallel planes, when the container is configured in the second configuration, to form a substantially flattened configuration.

11. A reconfigurable container according to claim 1, wherein the first wall portion comprises a rod mounted to the lateral edge of the first wall and at least one bearing configured to receive the rod so that the rod is rotatable in the bearing mounted to the lateral edge of the second wall portion.

12. A reconfigurable container according to claim 11, wherein the at least one bearing comprises an elongate C-shaped channel having an opening that enables the rod to be snap-located into the bearing.

13. A reconfigurable container according to claim 12, wherein the opening faces inside of the reconfigurable container when the wall is arranged to extend around the base.

14. A reconfigurable container according to claim 12, wherein the opening faces outside of the reconfigurable container when the wall is arranged to extend around the base.

15. A reconfigurable container according to claim 1, wherein the base has a substantially elliptical shape.

* * * * *